US012503805B2

(12) United States Patent
Huang et al.

(10) Patent No.: US 12,503,805 B2
(45) Date of Patent: Dec. 23, 2025

(54) ADDITIVE DELIVERY APPARATUS AND WASHING MACHINE

(71) Applicants: QINGDAO HAIER DRUM WASHING MACHINE CO., LTD., Shandong (CN); HAIER SMART HOME CO., LTD., Shandong (CN)

(72) Inventors: Tao Huang, Shandong (CN); Baozhen Cheng, Shandong (CN); Huacheng Zhang, Shandong (CN)

(73) Assignees: QINGDAO HAIER DRUM WASHING MACHINE CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 280 days.

(21) Appl. No.: 18/255,009

(22) PCT Filed: Nov. 26, 2021

(86) PCT No.: PCT/CN2021/133430

§ 371 (c)(1),
(2) Date: May 30, 2023

(87) PCT Pub. No.: WO2022/111622

PCT Pub. Date: Jun. 2, 2022

(65) Prior Publication Data

US 2024/0003074 A1 Jan. 4, 2024

(30) Foreign Application Priority Data

Nov. 27, 2020 (CN) ..... 202011356888.4

(51) Int. Cl.
*D06F 39/02* (2006.01)
*D06F 39/08* (2006.01)

(52) U.S. Cl.
CPC ..... *D06F 39/022* (2013.01); *D06F 39/028* (2013.01); *D06F 39/088* (2013.01)

(58) Field of Classification Search
CPC ..... D06F 39/022; D06F 39/028; D06F 39/088
See application file for complete search history.

(56) References Cited

U.S. PATENT DOCUMENTS 3,044,285 A * 7/1962 Koplin ..... D06F 33/37 68/17 R
2015/0337480 A1* 11/2015 Lee ..... D06F 39/028 68/17 R (Continued)

FOREIGN PATENT DOCUMENTS

CN 103668883 A 3/2014
CN 103668884 A 3/2014

(Continued)

OTHER PUBLICATIONS

Machine translation of DE 102019135111 A1 to Strothoff et al. (Year: 2021).*

(Continued)

*Primary Examiner* — Joseph L. Perrin
(74) *Attorney, Agent, or Firm* — BUCHANAN, INGERSOLL & ROONEY PC

(57) ABSTRACT

A turbulent flow structure is arranged in a water supply waterway and configured to form a vortex water flow, and mixes a delivered additive with inflow water; and an outlet of the water supply waterway is connected with a nozzle. An inlet of the water supply waterway of the additive delivery apparatus communicates with a washing machine water inflow pipe, and the nozzle of the additive delivery apparatus sprays an additive solution into the washing drum of the washing machine. The turbulent flow structure is arranged in the water supply waterway, so that an additive and water mixed solution in the water supply waterway will form the (Continued)

vortex water flow when flowing through the turbulent flow structure, to stir the additive and the water to be mixed, and mixing uniformity of the additive solution flowing out of the water supply waterway of the additive delivery apparatus is achieved.

18 Claims, 13 Drawing Sheets

(56) References Cited

U.S. PATENT DOCUMENTS

| | | | | |
|---|---|---|---|---|
| 2017/0268151 | A1* | 9/2017 | Leibman | D06F 39/022 |
| 2019/0169778 | A1* | 6/2019 | Uchiyama | D06F 33/00 |
| 2021/0002809 | A1* | 1/2021 | Huang | D06F 39/02 |
| 2021/0254253 | A1* | 8/2021 | Pollett | D06F 33/37 |

FOREIGN PATENT DOCUMENTS

| | | | | | |
|---|---|---|---|---|---|
| CN | 105200724 | A | * | 12/2015 | |
| CN | 105200725 | A | * | 12/2015 | |
| CN | 107541888 | A | | 1/2018 | |
| CN | 110938970 | A | | 3/2020 | |
| CN | 212771554 | U | | 3/2021 | |
| DE | 102019135111 | A1 | * | 6/2021 | |
| EP | 3683349 | A1 | | 7/2020 | |
| EP | 3839125 | A1 | * | 6/2021 | D06F 39/022 |
| WO | WO-2015178657 | A1 | * | 11/2015 | D06F 37/12 |
| WO | WO-2018078980 | A1 | * | 5/2018 | D06F 17/10 |

OTHER PUBLICATIONS

International Search Report (PCT/ISA/210) with translation and Written Opinion (PCT/ISA/237) mailed on Mar. 8, 2022, by the China National Intellectual Property Administration as the International Searching Authority for International Application No. PCT/CN2021/133430. (11 pages).

* cited by examiner

ADDITIVE DELIVERY APPARATUS AND WASHING MACHINE

TECHNICAL FIELD

The present disclosure belongs to the technical field of clothes treatment devices, particularly relates to an additive delivery apparatus of a washing machine, and further relates to a washing machine equipped with the above additive delivery apparatus.

BACKGROUND

An existing washing machine is generally provided with a water holding drum for washing water holding, and a rotatable washing drum is arranged in the water holding drum, and a dewatering hole connecting the inside and the outside is formed in the washing drum, so that washing water flowing into the water holding drum can use the dewatering hole to perform interactive flowing on the inside and the outside of the washing drum, so as to realize the effects of the washing water making contact with a load to be treated delivered in the washing drum and using the washing water to treat the load.

An additive delivery mode of the above existing washing machine is as follows: through an additive delivery apparatus, an additive is delivered into a pipeline connecting with the water holding drum of the washing machine, and then the delivered additive flows into the water holding drum of the washing machine along the pipeline. Therefore, the additive delivered in the existing mode is located inside the water holding drum and outside the washing drum of the washing machine, and cannot make direct contact with the load delivered in the washing drum.

Then, when the washing machine executes a washing procedure, the delivered additive is mixed with the washing water flowing into the water holding drum, part of the washing water mixed with the additive flows into the washing drum through the dewatering hole to contact the load to be treated in the drum, and only in this way can a small part of the additive mixed into the washing water make contact with the load and have an effect on the load. Therefore, the traditional additive delivery mode has the problems of low use efficiency of the delivered additive and additive waste.

Meanwhile, in the traditional additive delivery mode, in order to ensure that the additive delivered between the water holding drum and the washing drum is in contact with the load to be treated in the washing drum, a large amount of water needs to flow into the water holding drum until a water level of the washing water in the water holding drum is higher than the washing drum, so as to ensure that the washing water flows into the washing drum through the dewatering hole and the additive is in contact with the load in the washing drum. Therefore, the traditional additive delivery mode still has the problem of excessive water use in additive delivery.

In addition, the existing additive delivery apparatus is generally provided with a housing forming a water box, the water box is connected to a washing machine water inflow pipe in series; after the additive to be delivered flows into the water box through the waterway, when the washing machine inflow water flows through the water box, the additive to be delivered in the water box will be flushed out, and the flushed-out additive to be delivered will flow into the water holding drum and out of the washing drum of the washing machine along with the inflow water, so as to realize the purpose of delivering the additive.

However, the additive delivery apparatus of the above structure has problems:

1. the additive needs to flow through the water box to be delivered, so that a delivery path of the additive is prolonged, residues of the additive in the delivery path are increased, and the actual delivery amount is reduced; and
2. the additive flows through the inflow water to be flushed into the water holding drum via the water box, since a section of the water box is relatively large compared with the waterway, the speed of the water flow flowing through the water box will become slow, and the problems that the flowing-through water flow cannot flush the additive in time, and the additive remains in the water box are easily generated.

In view of this, the present disclosure is provided.

SUMMARY

The present disclosure aims to solve the technical problem of deficiency of the prior art and provides an additive delivery apparatus so as to realize the purpose that an additive is directly delivered outwards through a water supply waterway. Meanwhile, the present disclosure further provides an additive delivery apparatus so as to realize the purpose of mixing the additive in the water supply waterway with water, and improving mixing uniformity of the additive and water in a mixed solution sprayed out of a nozzle.

In order to achieve the above purposes of the present disclosure, a basic conception of a technical solution adopted by the present disclosure is:

the present disclosure provides an additive delivery apparatus, including:

- a water supply waterway, configured to allow water to flow through;
- a delivery unit, configured to deliver an additive to the water supply waterway; wherein
- a turbulent flow structure is arranged in the water supply waterway and configured to form a vortex water flow in the water supply waterway, and mix the delivered additive with inflow water; and
- a nozzle, wherein an outlet of the water supply waterway is connected with the nozzle, and the nozzle is configured to deliver the mixed additive and water.

Furthermore, the turbulent flow structure includes a plurality of convex ribs arranged in the water supply waterway at intervals, an interval is reserved between each convex rib and a side wall of the water supply waterway and configured to bear impact of an additive and water mixed solution in the water supply waterway, and the mixed solution is distributed towards two sides along outer walls of the convex ribs to form vortexes.

Furthermore, the plurality of convex ribs are arranged in the water supply waterway at intervals along a water flow direction, and a sectional area of a side towards an upper stream of the water supply waterway of each of the convex ribs towards an upper stream of the water supply waterway is greater than the sectional area of a side towards a downstream of the water supply waterway of each of the convex ribs.

Furthermore, the plurality of convex ribs are arranged in the water supply waterway at intervals in a plurality of rows and a plurality of columns.

Furthermore, the convex ribs extend along arc lines, and two end faces of the convex ribs are arc faces, configured to change a flowing direction of the additive and water mixed solution in the water supply waterway.

Furthermore, the plurality of arc convex ribs are arranged in the water supply waterway at intervals along the arc lines.

Furthermore, distances between two ends of each arc convex rib and a circle center of the arc lines are unequal.

Further preferably, a clockwise end of each arc convex rib and a counterclockwise end of each arc convex rib are located on different arc lines respectively, and two arc lines are arranged concentrically.

Furthermore, an impeller capable of rotating around a central shaft is arranged in the water supply waterway, and the central shaft of the impeller is perpendicular to the flowing direction of the additive and water mixed solution in the water supply waterway.

Furthermore, the central shaft of the impeller is directly connected with a driving motor or indirectly connected with the driving motor through a transmission structure, and the driving motor is configured to drive the impeller to rotate around the central shaft.

Furthermore, a liquid suction opening communicating with the delivery unit and allowing the additive to flow in is formed in the water supply waterway; and the turbulent flow structure is arranged in the water supply waterway downstream of the liquid suction opening.

Furthermore, the liquid suction opening is arranged close to an inlet of the water supply waterway.

Furthermore, a mixing part with an increased sectional area is arranged in the middle of the water supply waterway, and the turbulent flow structure is arranged in the mixing part.

Furthermore, the mixing part is a channel with the sectional area gradually increased from two ends to the middle, and at least part of the turbulent flow structure is arranged at a position with a maximum sectional area of the mixing part.

Further preferably, the turbulent flow structure is arranged at a position of an axis of the mixing part, and intervals exist between the turbulent flow structure and left and right side walls of the mixing part.

The other aim of the present disclosure is to provide a washing machine equipped with the above additive delivery apparatus, so as to realize the aim of directly delivering the additive into a washing drum, so that the delivered additive makes direct contact with a load to be treated in the washing drum to improve the use rate of the additive.

To realize the above aim of the present disclosure, a basic conception of a technical solution adopted by the present disclosure is:

the present disclosure further discloses a washing machine, including a washing drum configured to hold a load to be treated, and the above any additive delivery apparatus, the inlet of the water supply waterway of the additive delivery apparatus communicates with a washing machine water inflow pipe, the nozzle of the additive delivery apparatus sprays into the washing drum of the washing machine.

Furthermore, the nozzle is formed in a shell, and/or a door, and/or a water holding drum and/or a window mat of the washing machine, and a spraying outlet of the nozzle is formed towards the inside of the washing drum, and the additive solution sprayed out of the nozzle is directly sprayed into the washing drum.

By the adoption of the above technical solution, the present disclosure has following beneficial effects compared with the prior art:

1. Through the above apparatus of the present disclosure, the additive is directly delivered outwards through the waterway arranged on the delivery apparatus, the additive is prevented from flowing through the water box, not only reduces the flowing path of the additive, but also the amount of flushing water needed in additive delivery is reduced, and the use rate of the additive is greatly improved. Meanwhile, the additive solution flowing out of the waterway is directly sprayed through the nozzle, a coverage area of the sprayed-out additive solution is increased, and the additive solution may be directly sprayed to the load to be treated on a deep position of the washing drum.
2. The additive delivery apparatus is arranged on the washing machine, so that the additive of the washing machine directly flows to the nozzle through the water supply waterway and is directly sprayed into the washing drum through the nozzle, so that the purpose that the additive of the washing machine directly flows into the washing drum through the waterway of the delivery apparatus and is sprayed to the load to be treated without flowing through the water box and the water holding drum outside the washing drum, and therefore the additive solution is directly sprayed to the load to be treated in the washing drum is achieved.
3. In addition, the turbulent flow structure is arranged in the water supply waterway, so that the additive and water mixed solution in the water supply waterway will form the vortex water flow when flowing through the turbulent flow structure, so as to stir the additive and the water to be mixed, and the technological progress of improving the mixing uniformity of the additive solution flowing out of the water supply waterway of the additive delivery apparatus is achieved.

Meanwhile, the present disclosure is simple in structure, obvious in effect and suitable for popularization and application.

Specific implementation modes of the present disclosure will be further described in detail below in conjunction with accompanying drawings.

BRIEF DESCRIPTION OF THE DRAWINGS

The accompanying drawings serve as a part of the present disclosure and are used to provide further understanding of the present disclosure, and schematic embodiments and descriptions thereof of the present disclosure are used for explaining the present disclosure, but do not form improper limitations to the present disclosure. Apparently, the accompanying drawings in the descriptions below are merely some embodiments, and other accompanying drawings may also be obtained according to these accompanying drawings by those of ordinary skill in the art without paying creative effort. In the accompanying drawings.

Main components in figures are described.

Figure 1:
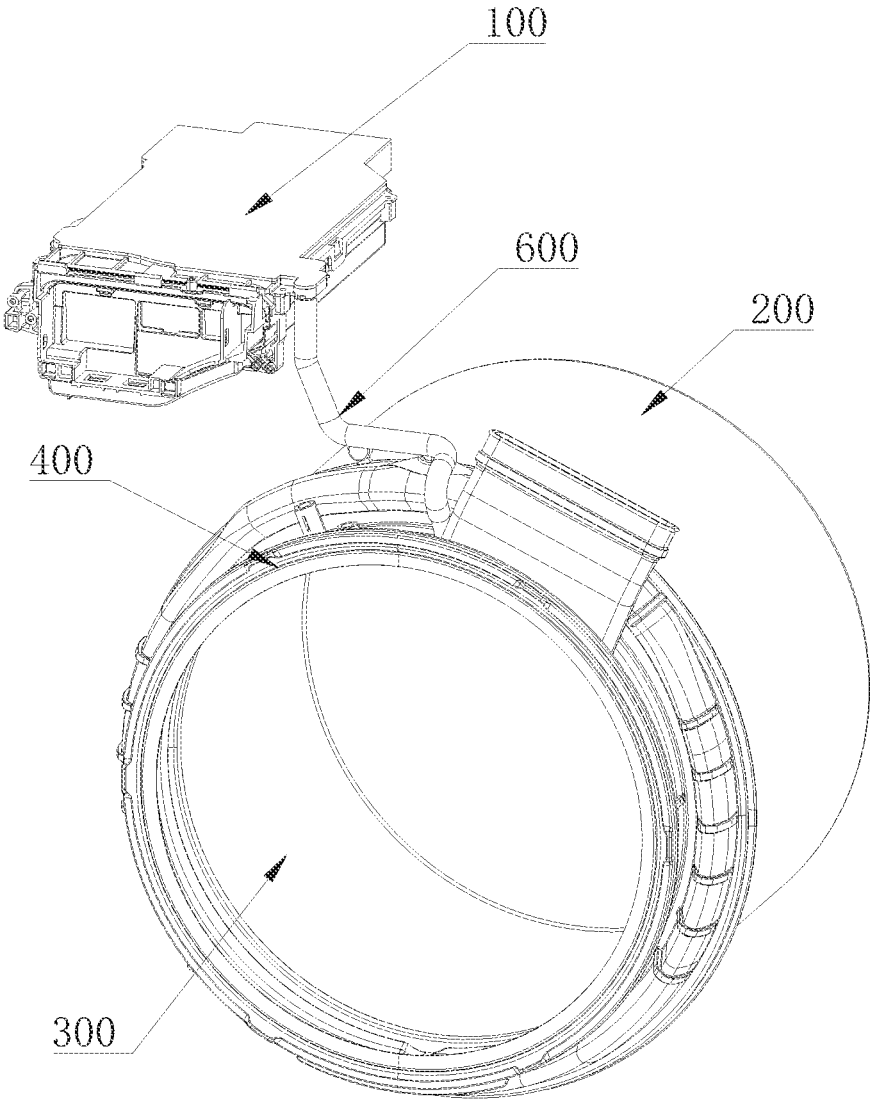
FIG. 1 to FIG. 3 are schematic structural diagrams of different viewing angles of a washing machine in an embodiment of the present disclosure.
Figure 2:
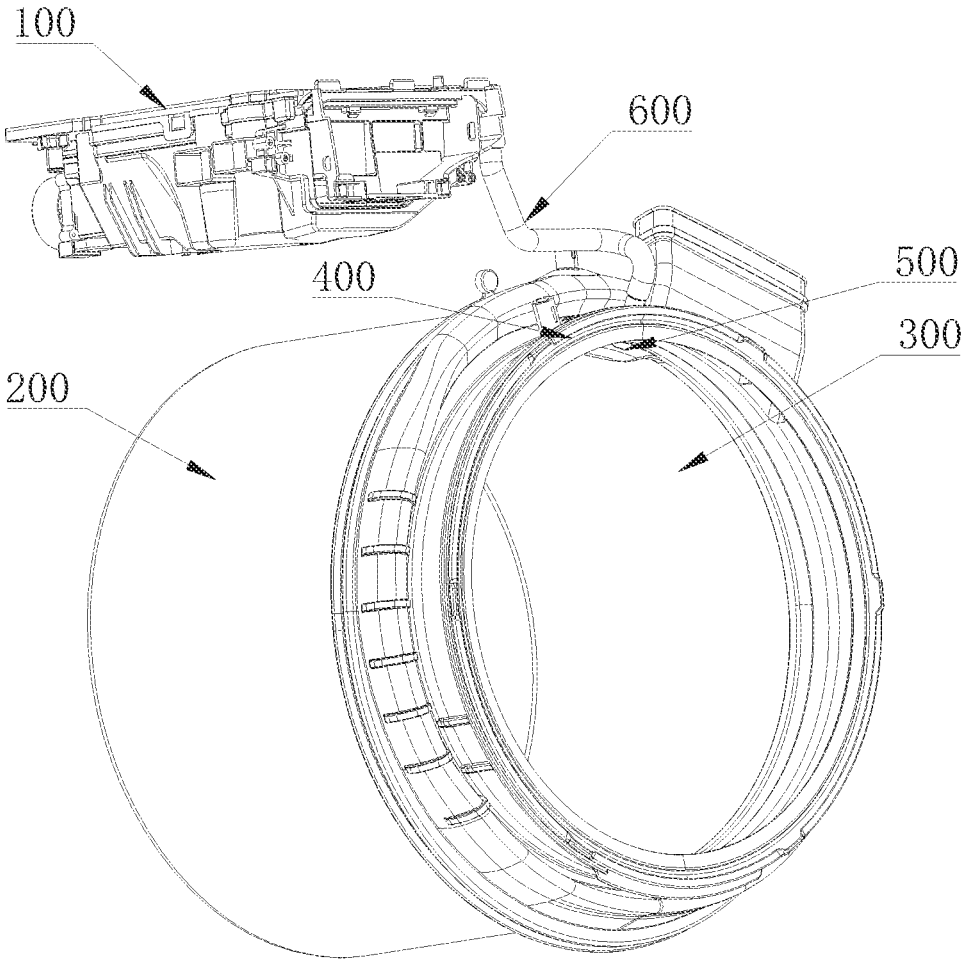
Figure 3:
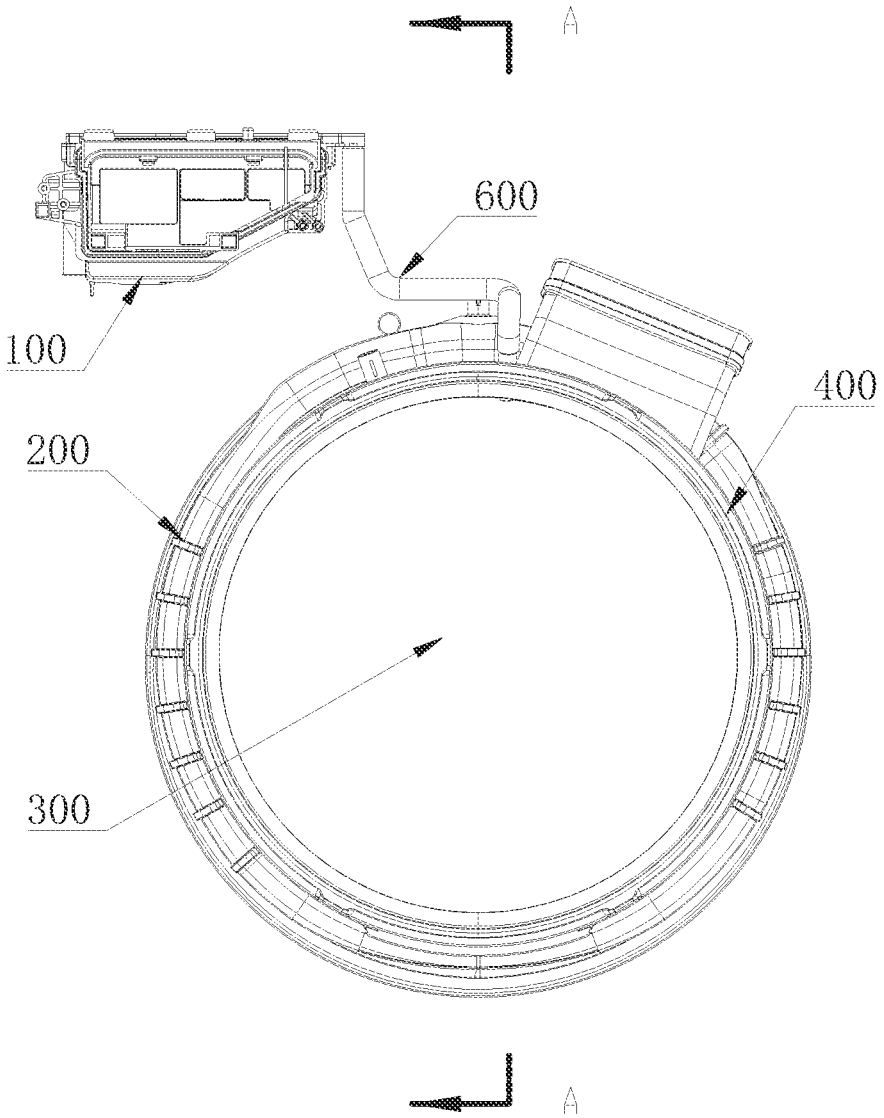
Figure 4:
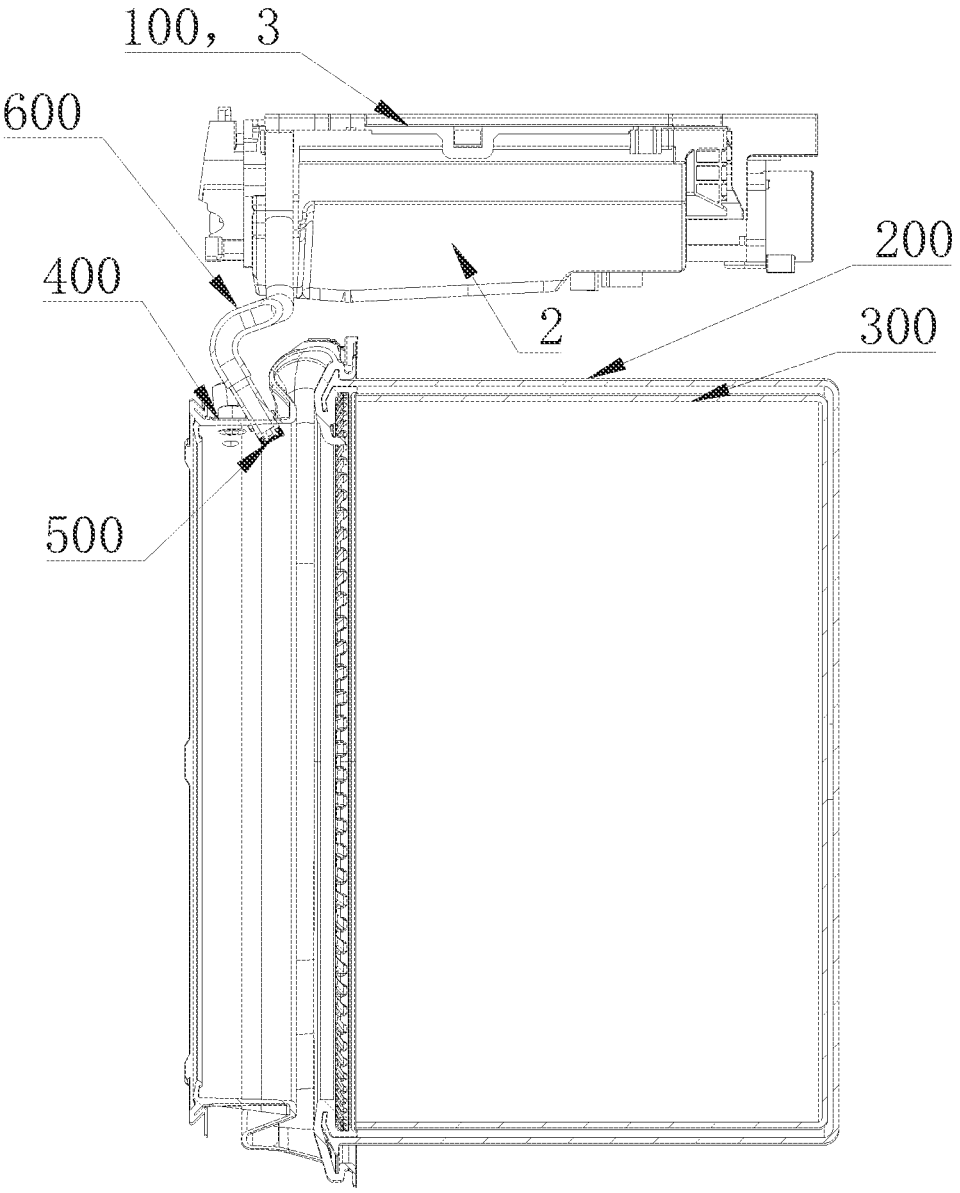
FIG. 4 is a schematic structural diagram of a section A-A of FIG. 3 in an embodiment of the present disclosure.
Figure 5:
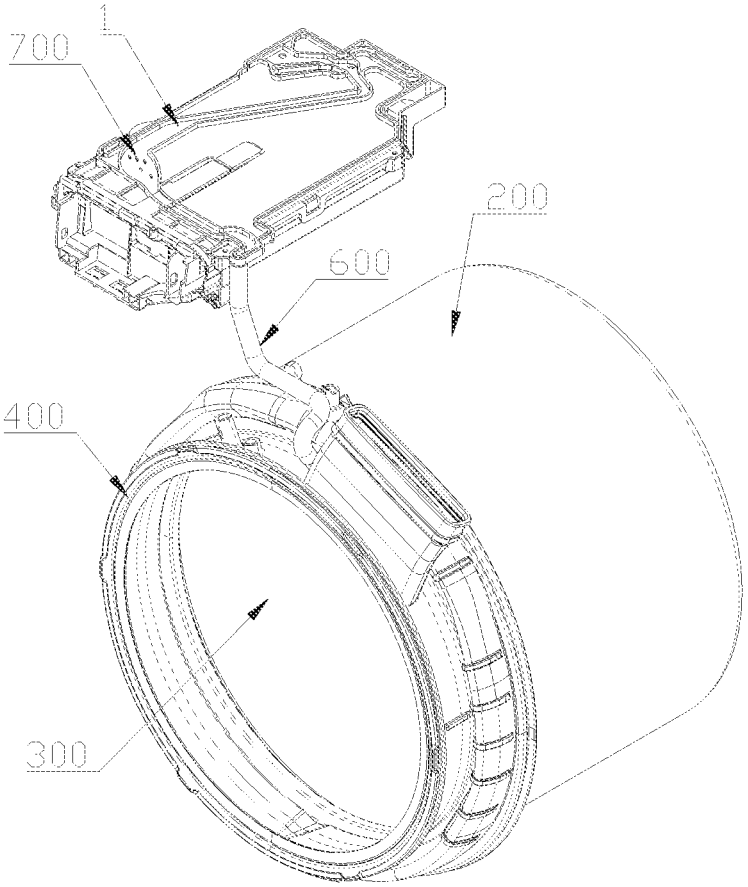
FIG. 5 is a schematic structural diagram of a washing machine with a first part of an upper cover removed in an embodiment of the present disclosure.

100. delivery apparatus; 200. water holding drum; 300. washing drum; 400. window mat; 500. nozzle; 600. guide pipe; 700. turbulent flow structure; 1. water supply waterway; 2. housing; 3. upper cover; 31. first part; 32. second part; 4. liquid storage cavity; 5. liquid storage box; 6. pump; 7. communicating apparatus; 8. liquid pumping flow channel; 11. outlet; 12. inlet; 13. liquid suction opening; 14. convex rib; impeller; 16. mixing part; 17. central shaft; 18. blades; 81. inlet; and 82. outlet.

It should be illustrated that these accompanying drawings and text descriptions are not intended to limit the conception range of the present disclosure, but illustrate the concept of the present disclosure by reference to specific embodiments for those skilled in the art.

DETAILED DESCRIPTION

In order to make the purposes, technical solutions and advantages of embodiments of the present disclosure clearer, the technical solutions in the embodiments of the present disclosure are described clearly and completely in combination with the accompanying drawings in the embodiments of the present disclosure. The following embodiments are used to illustrate the present disclosure, but do not limit the scope of the present disclosure.

In the descriptions of the present disclosure, it should be noted that the orientation or position relationship indicated by the terms "up", "down", "front", "back", "left", "right", "vertical", "inside", "outside", etc., is based on the orientation or position relationship shown in the accompanying drawings, the orientation or position relationship only facilitates the descriptions of the present disclosure and simplifies the descriptions instead of indicating or implying that the referred apparatus or element must have a particular orientation, and be constructed and operated in a particular orientation, and therefore it cannot be understood as a limitation to the present disclosure.

In the descriptions of the present disclosure, it is necessary to illustrate that, unless otherwise expressly specified and qualified, the terms "installation", "connection" and "link" shall be understood broadly, for example, they may be fixed connection, may also be detachable connection or integrated connections, may be mechanical connection, may also be electrical connection, may be direct connection and may also be indirect connection through an intermediation. For those ordinarily skilled in the art, the specific meaning of the above terms in the present disclosure may be understood in specific circumstances.

As shown in FIG. 1 to FIG. 8, an embodiment of the present disclosure further introduces a washing machine, including a water holding drum 200 configured to hold water, wherein a rotatable washing drum 300 configured to hold a load to be treated is arranged in the water holding drum 200, and an additive delivery apparatus 100 configured to directly deliver an additive into the washing drum 300. Through the above arrangement, the washing machine may achieve use effects of directly delivering the additive into the washing drum 300, and directly spraying the delivered additive on the load to be treated in the washing drum 300, which further achieves the remarkable technical progress of improving the use efficiency of the additive.

As shown in FIG. 1 to FIG. 8, the additive delivery apparatus 100 in the embodiment of the present disclosure includes:

- a water supply waterway 1, configured to allow inflow water entering the additive delivery apparatus 100 to flow through;
- a delivery unit, configured to deliver the additive to the water supply waterway 1; and
- a nozzle 500, wherein an outlet 11 of the water supply waterway 1 is connected with the nozzle 500, and the nozzle 500 is arranged towards the inside of the washing drum 300 of the washing machine. When the additive is delivered, a small amount of inflow water flows into the water supply waterway, so that the additive is mixed with the small amount of inflow water in the water supply waterway 1 to form an additive solution, and the additive solution supplied by the water supply waterway 1 may be directly sprayed on the load to be treated in the washing drum 300 through the nozzle 500, so that the use rate of the delivered additive is obviously improved.

Through the above apparatus, the additive is directly delivered outwards through the waterway arranged on the delivery apparatus 100, the additive is prevented from flowing through the water box. This not only reduces a flowing path of the additive, but also reduces the amount of flushing water needed for additive dispensing, greatly improving additive utilization.

As shown in FIG. 1 to FIG. 8, in the embodiment of the present disclosure, the water supply waterway 1 is integrated on a housing 2 of the additive delivery apparatus 100, the outlet 11 of the water supply waterway 1 is formed in an outer side of the housing 2, the nozzle 500 is arranged outside the housing 2, and the outlet 11 of the water supply waterway 1 communicates with the nozzle 500 through a guide pipe 600. Through integrated arrangement of the water supply waterway 1 on the housing 2 of the additive delivery apparatus 100, the outlet 11 of the water supply waterway 1 directly communicates with the nozzle 500, so as to commonly spray out the additive and the inflow water pumped out through the water supply waterway 1, and therefore the aim that the additive is directly sprayed and delivered by the additive delivery apparatus 100 through the nozzle 500 without passing through the water box of the delivery apparatus 100 is achieved.

As shown in FIG. 1 to FIG. 8, in the embodiment of the present disclosure, a turbulent flow structure 700 is arranged in the water supply waterway 1 of the additive delivery apparatus and is configured to form the vortex water flow in the water supply waterway 1 to mix the delivered additive with the inflow water; and the outlet of the water supply waterway 1 is connected with the nozzle 500, and the nozzle is configured to deliver the mixed additive and water.

The turbulent flow structure is arranged in the water supply waterway, so that when the additive and water mixed solution in the water supply waterway flows through the turbulent flow structure, the vortex water flow will be formed, so as to stir the additive and the water to be mixed, so that the remarkable technical progress of improving the mixing uniformity of the additive solution flowing out of the water supply waterway of the additive delivery apparatus is achieved.

Embodiment 1

As shown in FIG. 1 to FIG. 9, an additive delivery apparatus is introduced in the embodiment and includes a water supply waterway 1 configured to allow water to flow through; a delivery unit, configured to deliver an additive to the water supply waterway 1, wherein a turbulent flow structure 700 is arranged in the water supply waterway and configured to perform impact in the water supply waterway 1 to form a vortex water flow, and the delivered additive is mixed with inflow water; and a nozzle 500, wherein an outlet of the water supply waterway 1 is connected with the nozzle 500, and the nozzle is configured to deliver the mixed additive and water.

Figure 9:
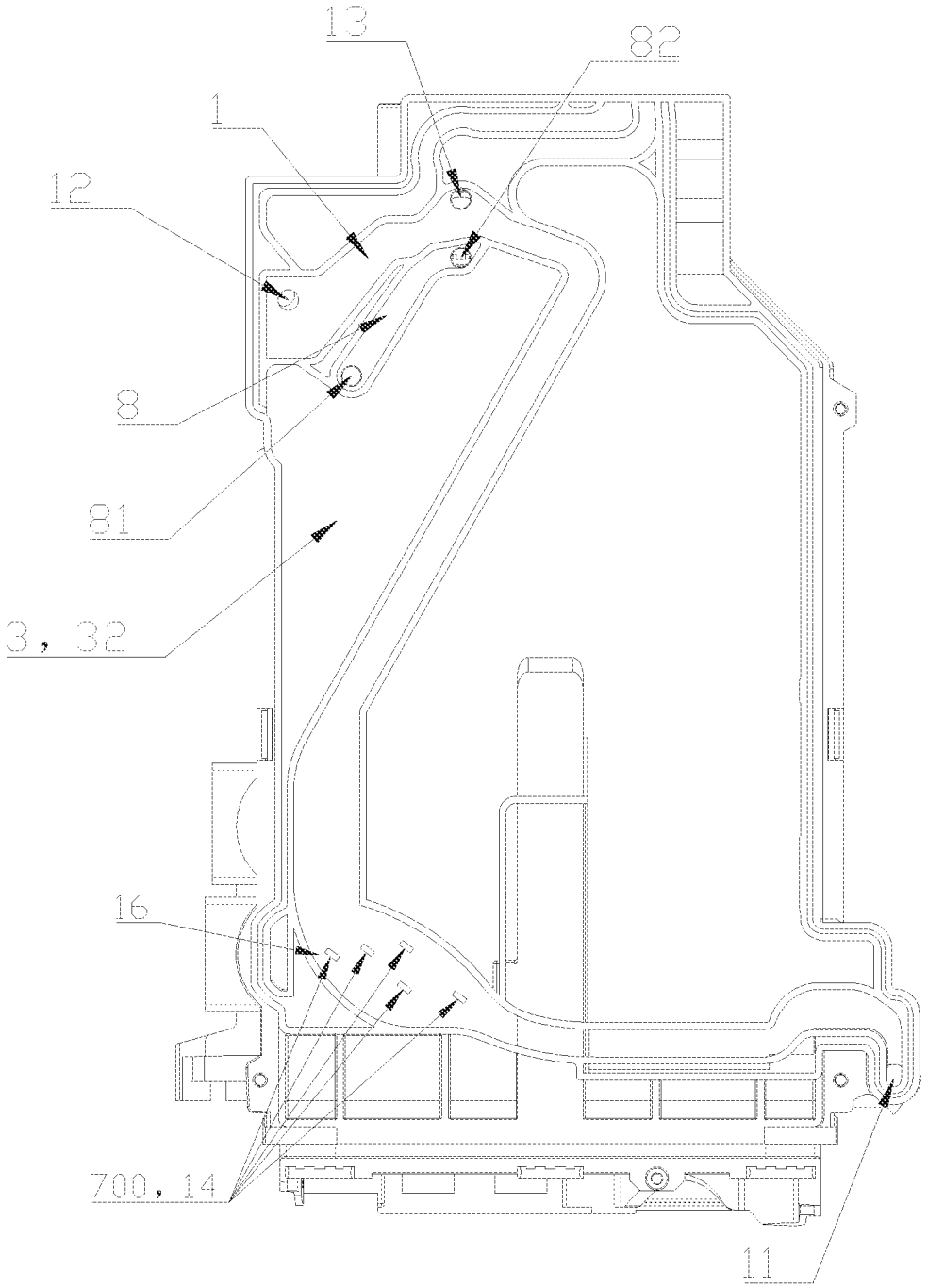
FIG. 9 to FIG. 12 are top schematic structural diagrams of an additive delivery apparatus with a first part of an upper cover removed in different embodiments of the present disclosure.
Figure 10:
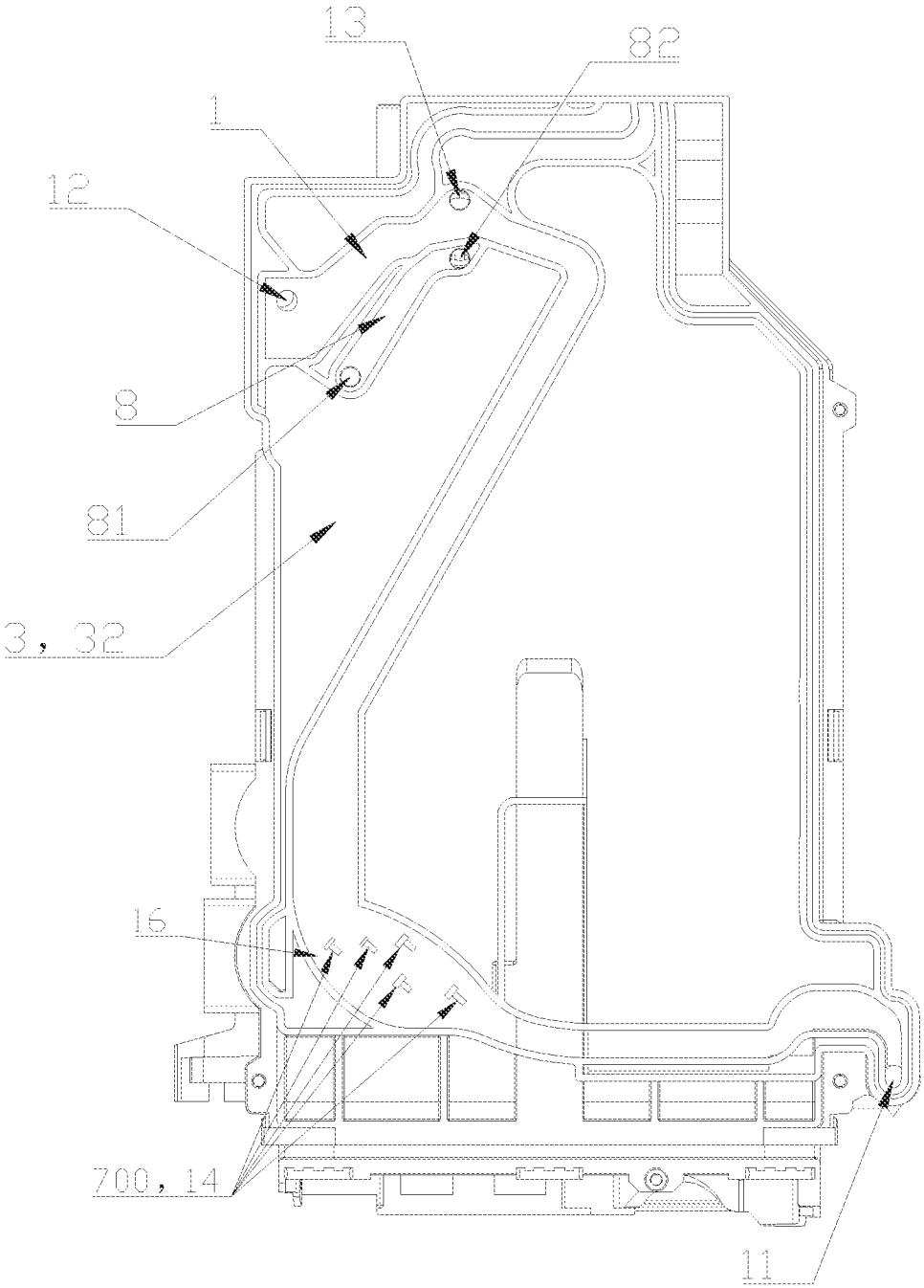

As shown in FIG. 9 and FIG. 10, in the embodiment, the turbulent flow structure 700 includes a plurality of convex ribs 14 arranged in the water supply waterway 1 at intervals, an interval is reserved between each convex rib 14 and a side wall of the water supply waterway and configured to bear impact of an additive and water mixed solution in the water supply waterway 1, and the impacted mixed solution flows towards two sides and upstream of each convex rib 14 at the position of each convex rib to form a vortex, stirring of the mixed solution is achieved, and therefore the aim of improving the mixing uniformity of the additive and the water is achieved.

In the embodiment, the convex ribs 14 may adopt any shape, as long as they are able to intercept the mixed solution flowing along the water supply waterway 1. For example, as shown in FIG. 9, the convex ribs 14 are convex ribs 14 vertically extending upwards from a bottom wall of the water supply waterway 1, upper ends of the convex ribs 14 are connected with a top wall of the water supply waterway 1, horizontal sections of the convex ribs 14 are rectangular, long sides of the rectangular convex ribs 14 are arranged in a mode of intersecting with a flowing direction of the mixed solution in the water supply waterway 1, so that the mixed solution may not directly impact different side walls of the convex ribs 14, the convex ribs 14 may use different side edges to block and intercept the mixed solution, and the aims of stirring the mixed solution and further improving the mixing uniformity are achieved.

In the embodiment, a distribution mode of each convex rib 14 in the water supply waterway 1 may adopt any form, for example, as shown in FIG. 9, the plurality of convex ribs 14 are arranged in the water supply waterway at intervals along the water flow direction, the convex ribs 14 are distributed in different sections of the water supply waterway 1, so as to block the mixed solution on different positions respectively, and a technical progress of performing multiple uniform processing on the mixed solution in a control point dividing mode and further improving the mixing uniformity of the additive and the water is further achieved. And, spacing distances between the convex ribs 14 are greater than widths of the convex ribs 14, so that the adjacent convex ribs 14 cannot intervene, and a stirring effect of the convex ribs 14 on the mixed solution is improved.

Preferably, as shown in FIG. 10, in the embodiment, sectional areas of sides of the convex ribs 14 towards an upper stream of the water supply waterway 1 are greater than sectional areas of sides of the convex ribs towards a downstream of the water supply waterway 1, so as to increase an interception area of the convex ribs 14 on the mixed solution, and the stirring effect of the convex ribs 14 on the mixed solution is improved.

Preferably, in the embodiment, in order to further improve the stirring effect of the convex ribs 14 on the mixed solution in the water supply waterway, the plurality of convex ribs 14 may be arranged in the water supply waterway 1 at intervals in a plurality of rows and a plurality of columns, so as to further increase a coverage range able to be stirred by the convex ribs 14 (not indicated in the accompanying drawings).

Embodiment 2

As shown in FIG. 1 to FIG. 8, FIG. 11 and FIG. 13, the embodiment introduces an additive delivery apparatus, including a water supply waterway 1 configured to allow water to flow through; a delivery unit, configured to deliver an additive to the water supply waterway 1, wherein a turbulent flow structure 700 is arranged in the water supply waterway 1 and configured to perform distribution in the water supply waterway 1 to form a vortex water flow, and the delivered additive is mixed with inflow water; and a nozzle 500, wherein an outlet of the water supply waterway 1 is connected with the nozzle 500, and the nozzle is configured to deliver the mixed additive and water.

Figure 11:
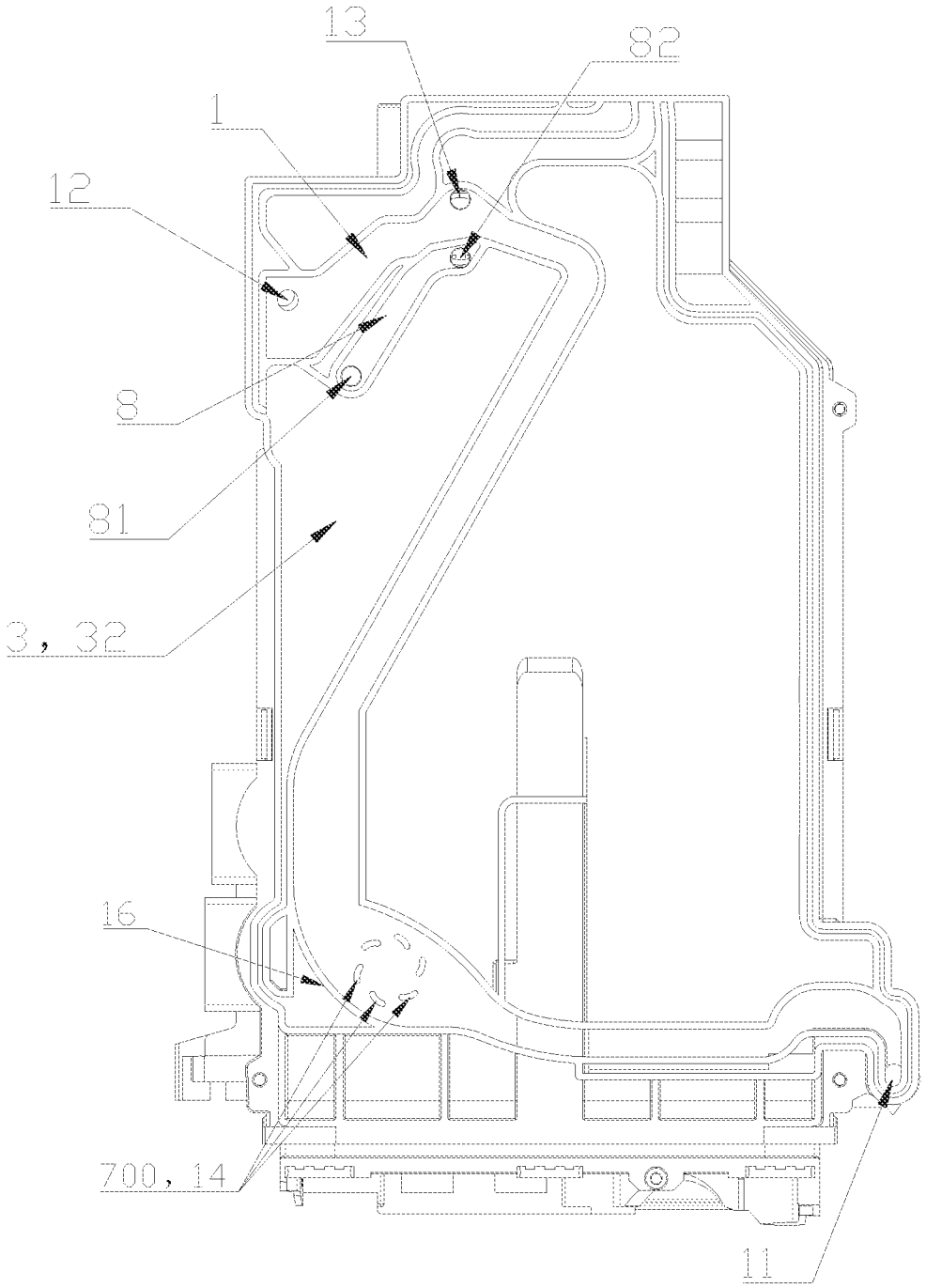
Figure 13:
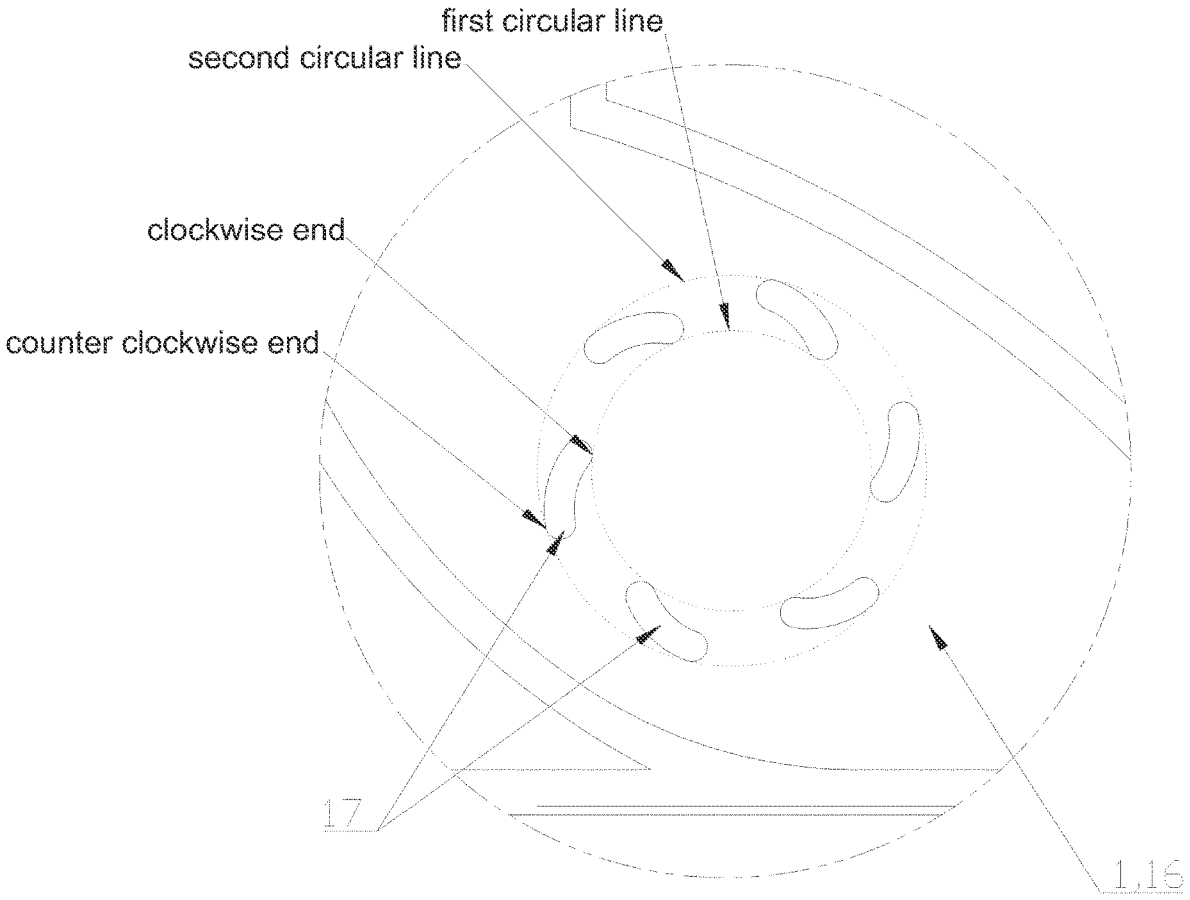
FIG. 13 is an enlarged schematic structural diagram of a position D of FIG. 11 in different embodiments of the present disclosure.

As shown in FIG. 11 and FIG. 13, in the embodiment, the turbulent flow structure 700 includes a plurality of convex ribs 14 arranged in the water supply waterway 1 at intervals, and the convex ribs 14 extend along arc lines so as to change a flowing direction of an additive and water mixed solution in the water supply waterway 1. When the mixed solution in the water supply waterway 1 flows to the arc convex ribs 14, the mixed solution is guided by the arc convex ribs 14 to be distributed towards a left side and a right side along the outer walls of the convex ribs 14, so that the flowing direction of the mixed solution is changed, the mixed solution with the changed flowing direction and a mixed solution with the unchanged flowing direction are crossed, and therefore the effect of improving the mixing uniformity of the additive and the water is achieved.

In the embodiment, in order to reduce resistance of the convex ribs 14 on the mixed solution, arc chamfers may be arranged on two end faces of the convex ribs 14, so that the water flow resistance may also be effectively reduced on the premise of improving the distribution effect of the convex ribs 14 on the mixed solution.

As shown in FIG. 11, in the embodiment, the plurality of arc convex ribs 14 arranged at intervals along the arc lines are arranged in the water supply waterway 1, so that the mixed solution in the water supply waterway 1 forms a vortex in a ring under the effect of the arc convex ribs 14 arranged along the ring, so that the flowing-through mixed solution is continuously stirred after entering the vortex, so as to achieve the technical progress of further improving the mixing uniformity of the additive and the water.

Preferably, as shown in FIG. 11 and FIG. 13, in the embodiment, distances between two ends of each arc convex rib 14 and a circle center of ring lines are not equal, so that a tangent line of each arc convex rib 14 and a tangent line of the ring lines are arranged in a staggered mode, so as to be beneficial to guiding the mixed solution in the water supply waterway to flow into the vortex in the ring lines or the mixed solution in the vortex flows out.

As shown in FIG. 11 and FIG. 13, in the embodiment, two ends of each arc convex rib 14 are a clockwise end and an anticlockwise end respectively, and the clockwise end is located on a clockwise direction side of the ring lines relative to the anticlockwise end. The clockwise ends of the arc convex ribs 14 are all located on a first ring line, the anticlockwise ends of the arc convex ribs 14 are all located on a second ring line, and the first ring line and the second ring line are concentric circles; and a diameter length of the first ring line is less than a diameter length of the second ring line.

Embodiment 3

As shown in FIG. 1 to FIG. 8, and FIG. 12, the embodiment introduces an additive delivery apparatus, including a water supply waterway 1 configured to allow water to flow through; a delivery unit, configured to deliver an additive to the water supply waterway 1, wherein a turbulent flow structure 700 is arranged in the water supply waterway 1 and configured to perform direct stirring in the water supply waterway 1 to form a vortex water flow, and the delivered additive is mixed with inflow water; and a nozzle 500, wherein an outlet of the water supply waterway 1 is connected with the nozzle 500, and the nozzle is configured to deliver the mixed additive and water.

Figure 12:
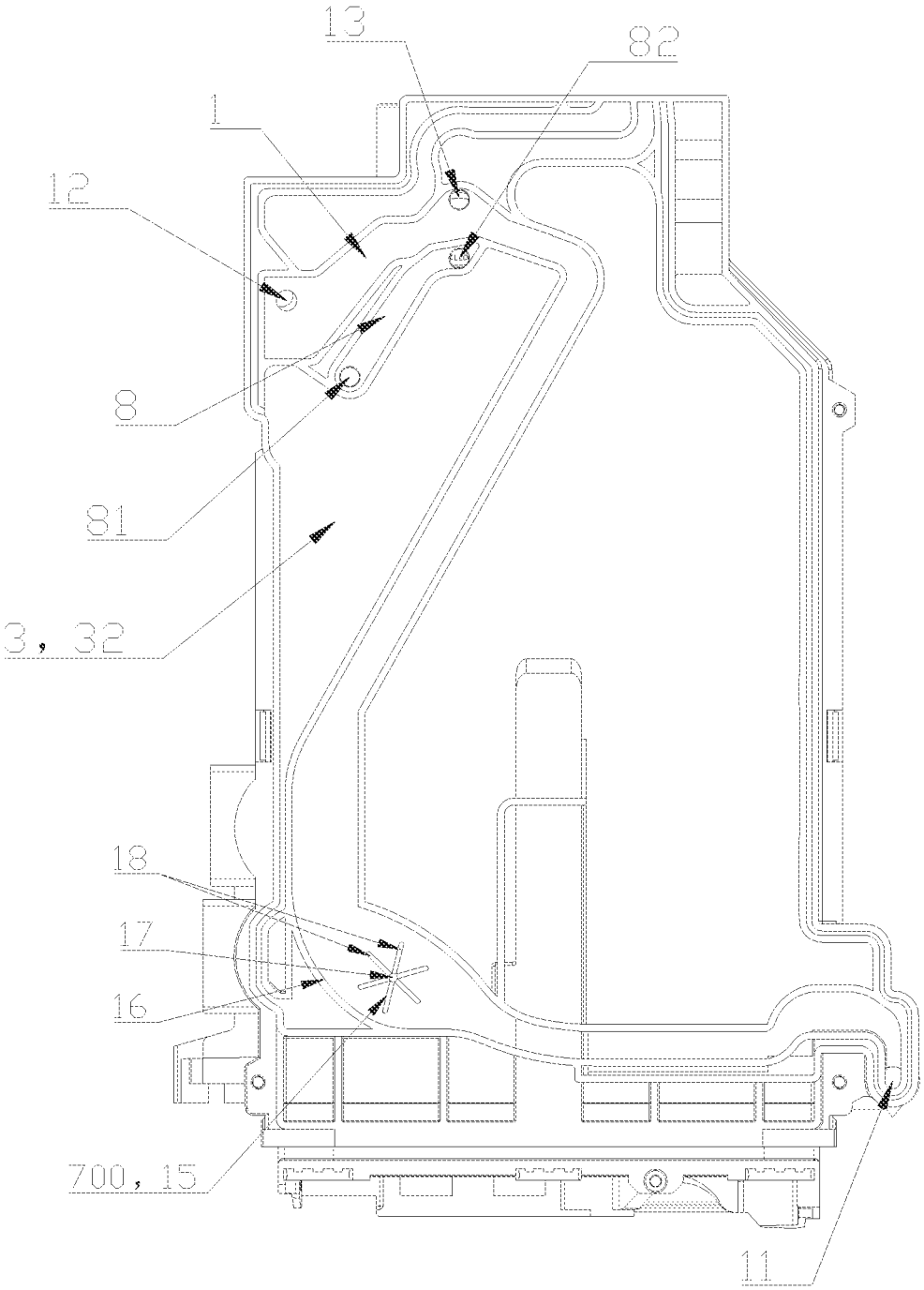

As shown in FIG. 12, in the embodiment, the turbulent flow structure 700 includes an impeller 115 capable of rotating around a central shaft in the water supply waterway 1, and the central shaft 17 of the impeller 15 is perpendicular to a flowing direction of an additive and water mixed solution in the water supply waterway 1. In the embodiment, the impeller 15 includes the central shaft 17, at least one end of the central shaft 17 and the water supply waterway 1 are connected in a mode of rotating around the central shaft, a plurality of blades 18 are arranged on a periphery of the central shaft 17 at intervals, the blades 18 extend in different radial directions of the central shaft 17, the blades 18 are symmetrically arranged relative to the central shaft 17, and an extension length of the blades 18 in the radial direction of the central shaft 17 is less than an interval between the central shaft 17 and the inner wall of the water supply waterway 1.

In the embodiment, the impeller 15 may be of a no-driving structure as shown in FIG. 12, and adopts a form of free setting, so that the impeller 15 is driven by the mixed solution flowing through the water supply waterway and rotates passively; and also, the central shaft of the impeller 15 is directly connected with a driving motor or indirectly connected with the driving motor through a transmission structure, the driving motor is configured to drive the impeller to rotate around the central shaft, so that the impeller is driven by the driving motor and rotates actively (not indicated in the accompanying drawings).

Embodiment 4

Based on the above embodiments 1 to 3, the embodiment introduces an additive delivery apparatus, including a water supply waterway 1 configured to allow water to flow through; a delivery unit, configured to deliver an additive to the water supply waterway 1, wherein a turbulent flow structure 700 is arranged in the water supply waterway 1 and configured to form a vortex water flow in the water supply waterway 1, and the delivered additive is mixed with inflow water; and a nozzle 500, wherein an outlet 11 of the water supply waterway 1 is connected with the nozzle 500, and the nozzle is configured to deliver the mixed additive and water.

In the embodiment, the turbulent flow structure 700 arranged in the water supply waterway 1 may be set by adopting any of the above embodiments 1 to 3, or in a combination form (not indicated in the accompanying drawings).

In the embodiment, the turbulent flow structure 700 arranged in the water supply waterway further has following technical features:

As shown in FIG. 9 to FIG. 12, in the embodiment, a liquid suction opening 13 connecting with the delivery unit and allowing the additive to flow in is formed in the water supply waterway 1 of the additive delivery apparatus, the turbulent flow structure 700 is arranged in the water supply waterway 1 downstream of the liquid suction opening 13, so that an objected effected by the turbulent flow structure 700 is the additive and water mixed solution, and the effect of improving the equilibrium uniformity of the additive and water mixed solution sprayed out of the additive delivery apparatus is achieved.

As shown in FIG. 9 to FIG. 12, in the embodiment, the liquid suction opening 13 is arranged close to an inlet 12 of the water supply waterway 1, so that the additive and inflow water mixed solution may flow through most of water supply waterway 1, and the length of the water supply waterway 1 is effectively used for mixing the mixed solution, and the mixing uniformity is effectively improved.

As shown in FIG. 9 to FIG. 12, in the embodiment, a mixing part 16 with a sectional area increased is arranged in the middle of the water supply waterway 1, and the turbulent flow structure 700 is arranged in the mixing part 16. The mixing part with the sectional area increased is arranged in the water supply waterway, so that the flow speed of the mixed solution flowing through the mixing part slows down, contact time of the mixed solution and the turbulent flow structure is prolonged, and therefore a mixing effect of the turbulent flow structure on the mixed solution is improved.

As shown in FIG. 9 to FIG. 12, in the embodiment, the mixing part 16 is a channel with the sectional area gradually increased from two ends to the middle, and at least part of the turbulent flow structure 700 is arranged at a position with a maximum sectional area of the mixing part 16, so that the mixing effect is further improved. Preferably, openings at two ends of the mixing part 16 face different directions, so as to further slowdown the flow speed of the water flow flowing through the mixing part, and the mixing effect of the additive and the inflow water is improved.

As shown in FIG. 9 to FIG. 12, in the embodiment, the turbulent flow structure 700 is arranged at the position of an axis of the mixing part 16 or close to the middle of the axis, intervals exist between the turbulent flow structure 700 and left and right side walls of the mixing part 16, so as to improve a coverage range of the turbulent flow structure 700 on the flowing-through mixed solution, and the mixing uniformity is improved.

Embodiment 5

The embodiment further has following technical features on the basis of the above embodiments 1 to 4.

Figure 7:
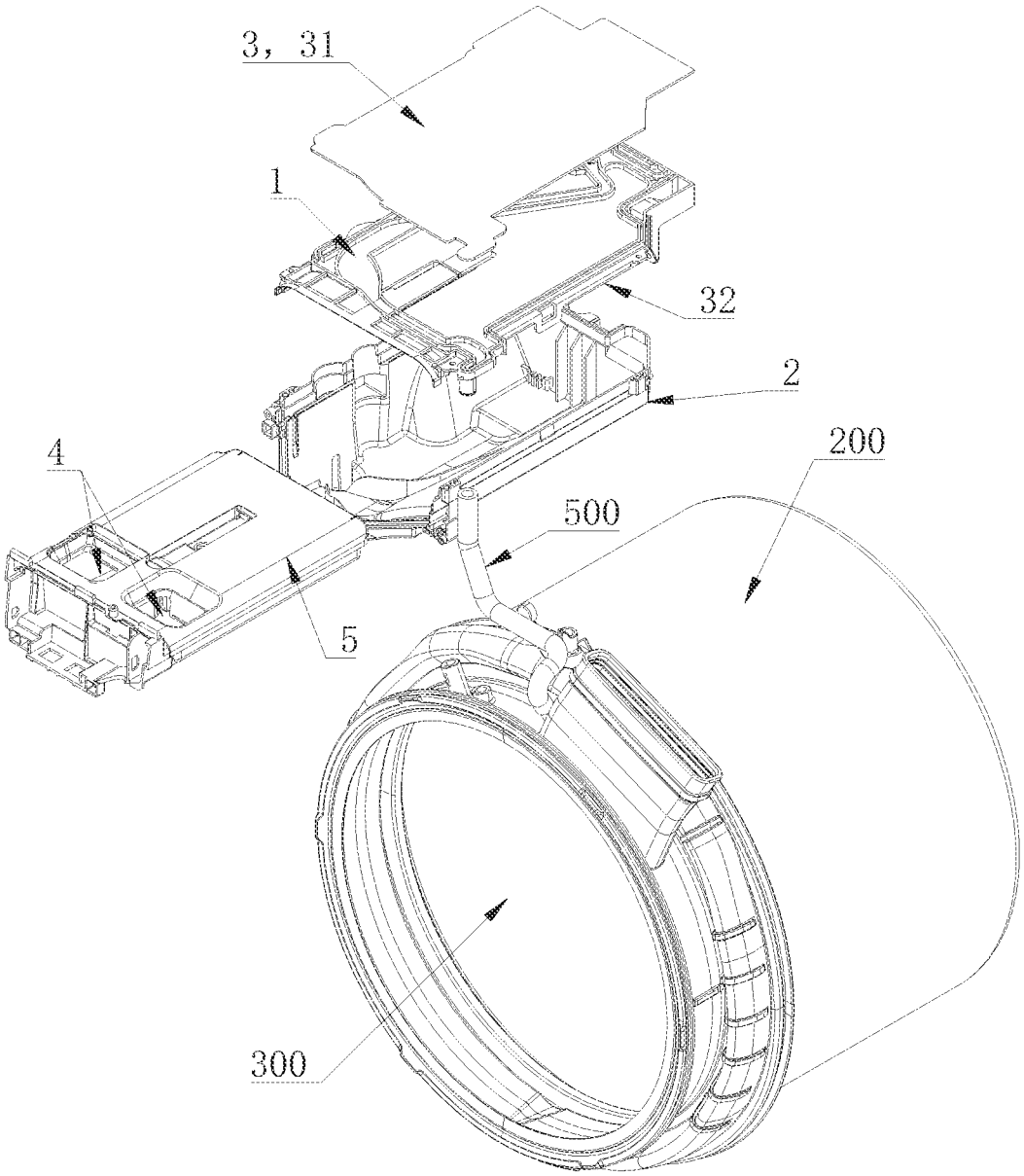
FIG. 7 and FIG. 8 are schematic structural diagrams of a washing machine after an additive delivery apparatus explodes in an embodiment of the present disclosure.
Figure 8:
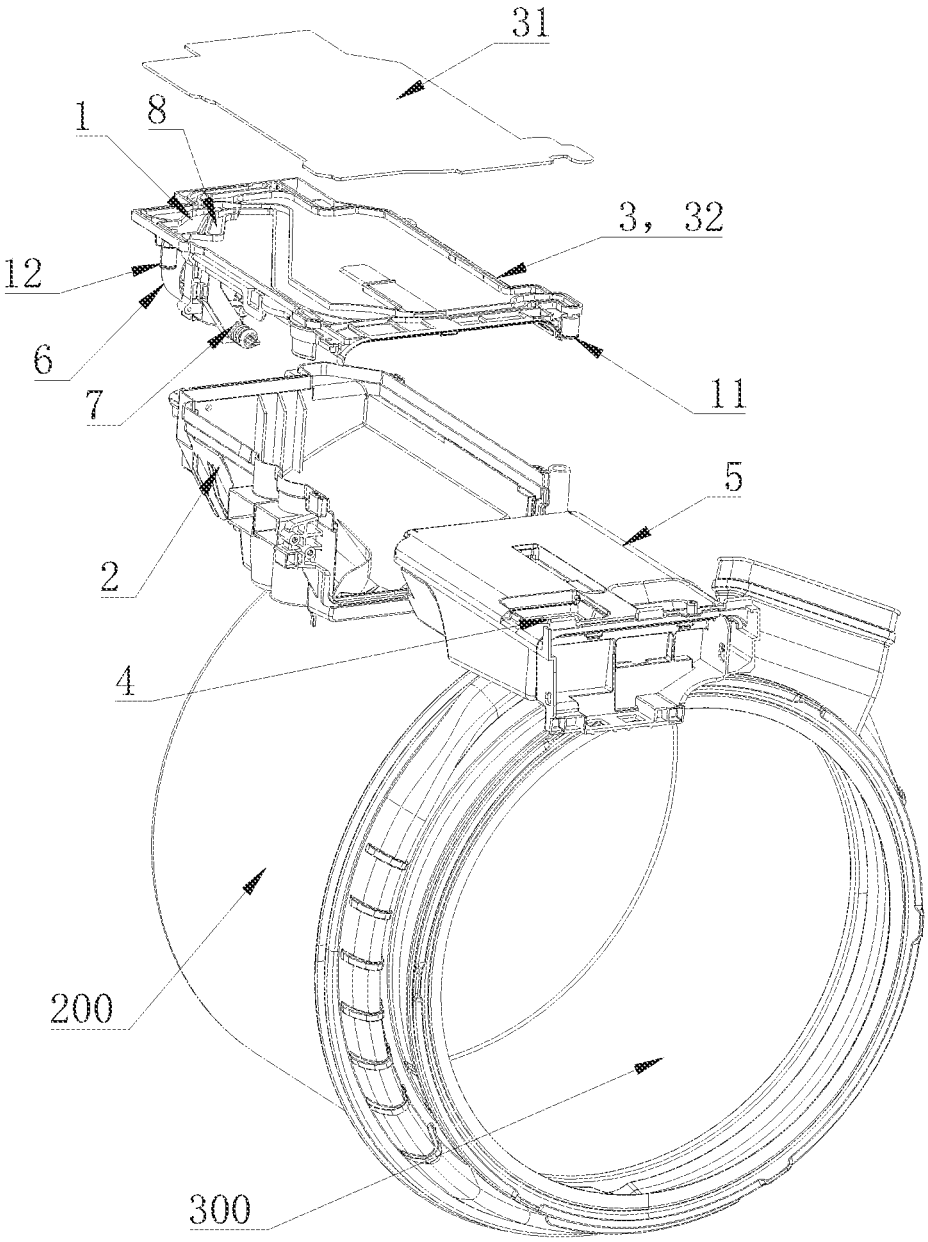

As shown in FIG. 7 and FIG. 8, in the embodiment, an upper cover 3 is arranged on a top of a housing 2 of the additive delivery apparatus 100, the water supply waterway 1 is arranged in the upper cover 3, an outlet 11 of the water supply waterway 1 is exposed out of a peripheral side of the upper cover 3, an inlet end of a guide pipe 600 communicates with the outlet 11 of the water supply waterway 1, and an outlet end of the guide pipe 600 communicates with a nozzle 500 arranged outside the housing 2. Preferably, the upper cover 3 includes a first part 31 and a second part 32 which are buckled up and down, the first part 31 and the second part 32 are oppositely spliced, and the water supply waterway 1 is formed on an opposite-splicing face. Further preferably, the first part 31 and the second part 32 of the upper cover 3 are connected through a welding process, so that a closed waterway structure capable of bearing pressure is formed inside.

Therefore, the water supply waterway 1 of the additive delivery apparatus 100 is integrated on the upper cover 3, and the inflow water and the additive of the delivery apparatus 100 are directly delivered through the water supply waterway 1 inside the upper cover 3, and therefore the effect that the additive directly flows outwards from the outlet 11 on the peripheral side of the upper cover 3 to be delivered is achieved.

In the embodiment, the delivery unit includes liquid storage cavities 4 allowing the additive to be stored, the liquid storage cavities 4 are communicated with the water supply waterway 1, a power unit is further arranged on the delivery apparatus 100, and the additives in the liquid storage cavities 4 are pumped into the water supply waterway to provide power.

As shown in FIG. 1 to FIG. 8, in the embodiment, the power unit is a pump 6 arranged on a liquid pumping flow channel 8 where the liquid storage cavities 4 are connected with the water supply waterway 1, and provides driving force of flowing in a direction from the liquid storage cavities 4 to the water supply waterway 1 for liquid in the liquid pumping flow channel 8. In the embodiment of the present disclosure, the liquid pumping flow channel 8 is also integrated in the upper cover 3, an inlet 81 of the liquid pumping flow channel 8 is communicated with the liquid storage cavities 4 through a communicating apparatus 7, an outlet 82 of the liquid pumping flow channel 8 is connected with an inlet of the pump 6, and an outlet of the pump 6 is connected with the liquid suction opening 13 formed in the water supply waterway 1. Through control starting and stopping of the pump 6, the purpose of pumping the additives in the liquid storage cavities 4 into the water supply waterway 1 to be delivered is achieved.

In the embodiment, the power unit may also be set to be of other existing structures, for example, the power unit is a suction pump, a suction opening of the suction pump is connected with the water supply waterway 1, so that negative pressure is formed in the water supply waterway 1, and the additives in the liquid storage cavities 4 are pumped to the water supply waterway 1 through the liquid pumping flow channel 8; and/or the power unit may also be a Venturi tube arranged on the water supply waterway 1, a negative pressure area with a suddenly-changed tube diameter is arranged on the Venturi tube, the negative pressure area may use the flowing-through water flow to form the negative pressure, a suction opening is formed in the negative pressure area of the Venturi tube, and the suction opening is connected with the liquid storage cavities 4 through the liquid pumping flow channel 8 (not indicated in the accompanying drawings).

In the embodiment, the additive delivery apparatus 100 includes the plurality of liquid storage cavities 4, and the liquid storage cavities 4 may hold different types of additives, for example, a detergent, a softener, a perfumer and a disinfectant. A control apparatus is arranged on the delivery apparatus 100, and the control apparatus is configured to control one or a combination of the liquid storage cavities 4 to be connected with the water supply waterway 1, so as to deliver any or simultaneously deliver a variety of combination categories of additives into the water supply waterway 1.

In the embodiment, the control apparatus may be set to be of any structure capable of achieving the above functions. For example, in the embodiment, each liquid storage cavity 4 may be connected to the water supply waterway 1 respectively through the flow channel equipped with a control valve, so as to realize an effect of separate or combined on-off control of each flow channel by controlling the opening and closing of each control valve, so as to realize the purpose of independent delivery of any category of additives or simultaneous delivery of a variety of categories of additives. And, the liquid storage cavities 4 may be connected with different inlets of the same reversing valve in a one-to-one corresponding mode, an outlet of the reversing valve is connected with the water supply waterway 1, and the reversing valve is provided with a rotating valve element to be configured to control any or a combination of the inlets to be connected with the outlet, which may also realize the purpose of delivering any category of additives independently or a variety of categories of additives at the same time (not indicated in the accompanying drawings).

As shown in FIG. 1 to FIG. 8, in the embodiment, a liquid storage box 5 is arranged in the housing 2 of the delivery apparatus 100, and the liquid storage box 5 may be installed in the housing 2 of the additive delivery apparatus 100 in an outward-drawing mode; and the liquid storage box 5 is provided with at least one liquid storage cavity 4 for the storage of the additive. Each liquid storage cavity 4 on the liquid storage box 5 is connected with water supply waterway 1 through the communicating apparatus 7, and the communicating apparatus 7 is provided with the control apparatus for controlling each liquid storage cavity 4 to be connected with the water supply waterway 1 in an alternative or combined controllable-on-off mode.

In the embodiment, the inlet 12 of the water supply waterway 1 is arranged on the outer wall of the housing 2, and the inlet 12 of the water supply waterway 1 is communicated with a water supply source so that the inflow water flow may flow into the water supply waterway 1.

In the embodiment, the additive delivery apparatus 100 is installed on a washing machine, and the water supply source of the additive delivery apparatus is the washing machine water inflow pipe. The inlet 12 of the water supply waterway 1 is communicated with the washing machine water inflow pipe so that washing inflow water may flow into the water supply waterway 1 through the inlet 12. The housing 2 of the additive delivery apparatus 100 is provided with an inflow connector, and two ends of the inflow connector are respectively communicated with the inlet 12 of the water supply waterway 1 and the water inflow pipe of the water supply waterway 1; and further preferably, a control valve controlling the waterway to be on or off is installed at the inflow connector.

The present disclosure arranges the above additive delivery apparatus 100 on the washing machine, so that the additive of the washing machine directly flows into the nozzle 500 through the water supply waterway 1, and is directly sprayed into the washing drum 300 through the nozzle 500, so that the additive of the washing machine does not flow through the water box or the water holding drum 200 outside the washing drum 300, but directly flows into the washing drum 300 from the waterway of the delivery apparatus 100 to be sprayed to the load to be treated, and therefore the purpose that the additive solution is directly sprayed into the load to be treated in the washing drum 300 is achieved. At the same time, through the above arrangement, the washing machine equipped with the additive delivery apparatus 100 may realize that the additive solution formed by mixing the additive with a small amount of water in the water supply waterway 1 may be directly sprayed on the load to be treated in the washing drum 300, and thus the utilization rate of the delivered additive is significantly improved.

Figure 6:
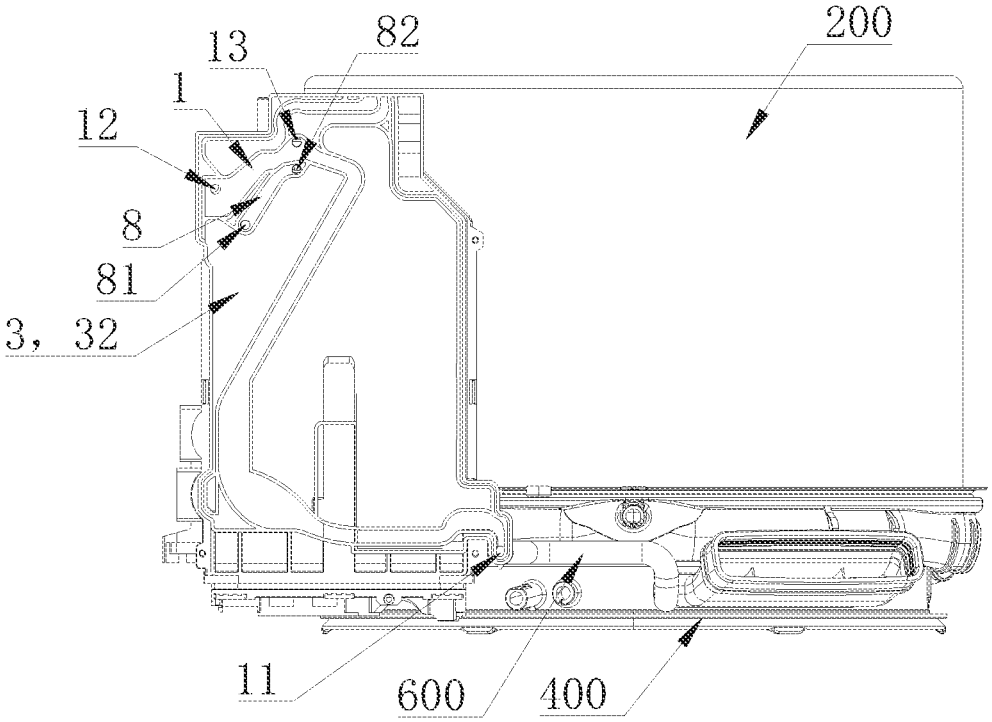
FIG. 6 is a top schematic structural diagram of a washing machine with a first part of an upper cover removed in an embodiment of the present disclosure.

As shown in FIG. 6 to FIG. 8, in the embodiment, the middle of the water supply waterway 1 is provided with the liquid suction opening 13, and the liquid suction opening 13 is communicated with the delivery unit so that the additives are pumped into water supply waterway 1 from the liquid suction opening 13. Preferably, the liquid suction opening 13 is communicated with the outlet of the pump 6, the inlet of the pump 6 is communicated with the outlet 82 of the liquid pumping flow channel 8, the inlet 81 of the liquid pumping flow channel 8 is communicated with the outlet of the communicating apparatus 7, and a plurality of inlets of the communicating apparatus 7 are communicated with the liquid storage cavities 4 in a one-to-one correspondence mode, so that the purpose that the additives in the liquid storage cavities 4 are pumped into the water supply waterway 1 through the above flow channel under the driving action of the pump 6 is achieved.

As shown in FIG. 6, in the embodiment, part of the water supply waterway 1 downstream of the liquid suction opening 13 may mix the additive flowing into the water supply waterway 1 with the inflow water to form the additive solution. Preferably, the liquid suction opening 13 is arranged close to the inlet 12 of the water supply waterway 1 to extend the length of the water supply waterway 1 downstream of the liquid suction opening 13 as far as possible, so as to increase part of space downstream of the water supply waterway 1 allowing the additive to be mixed with the water, and thus the mixing uniformity between the additive and the water is improved.

In the embodiment, the nozzle 500 may be formed in a shell, and/or a door, and/or a water holding drum 200 and/or a window mat 400 of the washing machine, a spraying outlet of the nozzle 500 is formed towards the inside of the washing drum 300, and the additive sprayed out of the nozzle 500 is directly sprayed into the washing drum 300.

Preferably, in the embodiment, a specific installing mode of the nozzle 500 is as follows: As shown in FIG. 1 to FIG. 8, a ring of window mat 400 is installed at a drum opening of the water holding drum 200, the window mat 400 is drum-shaped, one end of the drum-shaped window mat 400 is connected with the drum opening of the water holding drum 200, and the other end is connected with the shell of the washing machine to form a channel. A drum opening of the washing drum 300 is oppositely connected with one end of the above channel, the shell of the washing machine is provided with a clothing delivery opening correspondingly connecting with the other end of the above channel, the shell of the washing machine is provided with the door capable of correspondingly opening and closing the clothing delivery opening, and a closed space is formed in the water holding drum 200 after the door is closed. There is a clearance space between the door and the window mat 400, and the clearance space is directly communicated with the inside of the washing drum 300 through the drum opening of the washing drum 300; and the nozzle is installed on a top of the window mat 400, the nozzle 500 penetrates through the window mat 400, the spraying outlet is formed on a portion of the nozzle 500 located on an inner peripheral side of the window mat 400, the inlet is located on a portion of the nozzle 500 on the peripheral side of the widow mat 400. A flow channel is arranged in the nozzle 500, two ends of the flow channel are communicated with the inlet and the spraying outlet respectively, and the spraying outlet is arranged towards a direction of the drum opening of the washing drum 300, so that the additive solution sprayed out of the nozzle 500 may be directly sprayed into the washing drum 300, so as to achieve the remarkable technical progress that the additive is directly sprayed on the load to be treated in the washing drum 300 and the delivery efficiency of the additive is improved.

In the embodiment, the nozzle 500 may be of any existing spraying structure, and the spraying outlet may be arranged as a plurality of spraying small holes arranged at intervals and may also be arranged as a single opening.

In the embodiment, an independent guide pipe 600 located outside the housing of the additive delivery apparatus 100 and outside the water holding drum 200 is arranged in the washing machine, two ends of the guide pipe 600 are respectively connected with the inlet of the nozzle 500 and the outlet 11 of the water supply waterway 1 in an oppositely-inserted mode, so that the additive solution supplied by the water supply waterway 1 may be directly drained to the nozzle 500 through the guide pipe 600, and the effect of directly spraying and delivering the additive into the washing drum 300 of the washing machine is achieved. Preferably, the above guide pipe 600 is made of materials like rubber, and the guide pipe can be bent and deformed.

The above embodiments are only preferred embodiments of the present disclosure and are not intended to limit the present disclosure in any form. Although the present disclosure has been disclosed as above in the preferred embodiments, it is not intended to limit the present disclosure. Any technical person familiar with the patent shall use technical contents suggested above to make some changes or modifications to equivalent embodiments of equivalent changes without departing from the scope of the technical solution of the present disclosure, however, any simple amending, equivalent change and modification on the above embodiments according to the technical essence of the present disclosure without departing the content of the technical solution of the present disclosure still fall within the scope of the technical scheme of the present disclosure.

The invention claimed is:

1. An additive delivery apparatus, comprising:

a water supply waterway, configured to allow water to flow through;

a delivery unit, configured to deliver an additive to the water supply waterway; wherein:

a turbulent flow structure is arranged in the water supply waterway and configured to form a vortex water flow in the water supply waterway, and mix the additive with inflow water;

a nozzle, an outlet of the water supply waterway is connected with the nozzle, and the nozzle is configured to deliver the mixed additive and water;

an upper cover is arranged on a top of a housing of the delivery apparatus, the water supply waterway is arranged in the upper cover, and the outlet of the water supply waterway is exposed out of a peripheral side of the upper cover; and an independent guide pipe is arranged outside the housing, an inlet end of the guide pipe communicates with the outlet of the water supply waterway, and an outlet end of the guide pipe communicates with the nozzle arranged outside the housing, so as to commonly spray out the additive and the inflow water pumped out through the water supply waterway, and the additive is directly sprayed and delivered by the additive delivery apparatus through the nozzle without passing through the water box of the delivery apparatus.

2. The additive delivery apparatus according to claim 1, wherein the turbulent flow structure comprises a plurality of convex ribs arranged in the water supply waterway at intervals, an interval is reserved between each of the convex ribs and a side wall of the water supply waterway, and configured to bear impact of a mixed solution of additive and water in the water supply waterway, and the mixed solution is distributed towards two sides along outer walls of the convex ribs to form vortexes.

3. The additive delivery apparatus according to claim 2, wherein the plurality of convex ribs are arranged in the water supply waterway at intervals along a water flow direction, and a sectional area of a side towards an upper stream of the water supply waterway of each of the convex ribs is greater than the sectional area of a side towards a downstream of the water supply waterway of each of the convex ribs.

4. The additive delivery apparatus according to claim 3, wherein the plurality of convex ribs are arranged in the water supply waterway at intervals in a plurality of rows and a plurality of columns.

5. The additive delivery apparatus according to claim 2, wherein the convex ribs extend along arc lines, and two end faces of each of the convex ribs are arc faces, configured to change a flowing direction of the mixed solution in the water supply waterway.

6. The additive delivery apparatus according to claim 5, wherein a plurality of arc convex ribs are arranged in the water supply waterway at intervals along the arc lines.

7. The additive delivery apparatus according to claim 6, wherein distances between two ends of each of the arc convex ribs and a circle center of the arc lines are unequal.

8. The additive delivery apparatus according to claim 2, wherein an impeller capable of rotating around a central shaft is arranged in the water supply waterway, and the central shaft of the impeller is perpendicular to a flowing direction of the mixed solution of additive and water in the water supply waterway.

9. The additive delivery apparatus according to claim 2, wherein a liquid suction opening communicating with a delivery unit and allowing the additive to flow in is formed in the water supply waterway; and the turbulent flow structure is arranged in the water supply waterway downstream of the liquid suction opening.

10. The additive delivery apparatus according to claim 2, wherein a mixing part with an increased sectional area is arranged in a middle of the water supply waterway, and the turbulent flow structure is arranged in the mixing part.

11. The additive delivery apparatus according to claim 1, wherein an impeller capable of rotating around a central shaft is arranged in the water supply waterway, and the central shaft of the impeller is perpendicular to a flowing direction of the mixed solution of additive and water in the water supply waterway.

12. The additive delivery apparatus according to claim 11, wherein the central shaft of the impeller is directly connected with a driving motor or indirectly connected with the driving motor through a transmission structure, and the driving motor is configured to drive the impeller to rotate around the central shaft.

13. The additive delivery apparatus according to claim 1, wherein a liquid suction opening communicating with a delivery unit and allowing the additive to flow in is formed in the water supply waterway; and the turbulent flow structure is arranged in the water supply waterway downstream of the liquid suction opening.

14. The additive delivery apparatus according to claim 13, wherein the liquid suction opening is arranged close to an inlet of the water supply waterway.

15. The additive delivery apparatus according to claim 1, wherein a mixing part with an increased sectional area is arranged in a middle of the water supply waterway, and the turbulent flow structure is arranged in the mixing part.

16. The additive delivery apparatus according to claim 15, wherein the mixing part is a channel with the sectional area gradually increased from two ends to middle, and at least part of the turbulent flow structure is arranged at a position with a maximum sectional area of the mixing part.

17. The additive delivery apparatus according to claim 15, wherein the turbulent flow structure is arranged at a position of an axis of the mixing part, and intervals exist between the turbulent flow structure and left and right side walls of the mixing part.

18. A washing machine, comprising a washing drum configured to hold a load to be treated, and further comprising the additive delivery apparatus according to claim 1, wherein an inlet of the water supply waterway of the additive delivery apparatus communicates with a water inflow pipe of the washing machine, the nozzle of the additive delivery apparatus is formed in a shell, and/or a door, and/or a water holding drum and/or a window mat of the washing machine, and the nozzle sprays into the washing drum of the washing machine.

* * * * *